US005915423A

United States Patent [19]

Thomas

[11] Patent Number: 5,915,423

[45] Date of Patent: Jun. 29, 1999

[54] BRIDGE CONSTRUCTION

[75] Inventor: Lindsey Maitland Thomas, Broadbottom via Hyde, United Kingdom

[73] Assignee: Williams Fairey Engineering Limited, Derby, United Kingdom

[21] Appl. No.: 08/863,825

[22] Filed: May 27, 1997

[51] Int. Cl.[6] ..... E01D 15/12

[52] U.S. Cl. ..... 14/2.4; 14/2.5; 14/77.1

[58] Field of Search ..... 14/2.4, 2.5, 2.6, 14/77.1

[56] References Cited

U.S. PATENT DOCUMENTS

| | | | |
|---|---|---|---|
| 3,490,605 | 1/1970 | Koss . | |
| 4,288,881 | 9/1981 | Mahncke et al. . | |
| 4,299,002 | 11/1981 | Wagner et al. | 14/2.4 |
| 4,521,932 | 6/1985 | Parramore . | |
| 4,825,492 | 5/1989 | Zehavi et al. | 14/2.4 X |
| 4,920,595 | 5/1990 | Fussinger et al. . | |
| 4,972,538 | 11/1990 | Parramore . | |
| 5,103,523 | 4/1992 | Drago et al. . | |
| 5,363,527 | 11/1994 | Rainaud et al. | 14/2.4 |
| 5,732,430 | 3/1998 | Beitz et al. | 14/2.5 |

FOREIGN PATENT DOCUMENTS

| | | | |
|---|---|---|---|
| 0168725 | 1/1986 | European Pat. Off. | 14/2.4 |
| 000475853 | 3/1992 | European Pat. Off. | 14/2.4 |
| 196 20 511 A1 | 5/1996 | United Kingdom . | |

*Primary Examiner*—Tamara Grarsay
*Assistant Examiner*—Sunil Singh
*Attorney, Agent, or Firm*—Wallenstein & Wagner, Ltd

[57] ABSTRACT

A method of constructing a modular bridge across a span (20) is disclosed. A vehicle (1) is positioned next to the span (20). The vehicle has a launching assembly (10) including an A-frame (40) which is moved from a stored position, in the launching assembly, to an upright, deployed position. A modular launching beam (110) is constructed by sequentially attaching modules (90,90') and then booming the launching beam as it is constructed out across the span (20). Once completed, the launching beam is pivoted about the A-frame (40) to lower the far bank end of the launching beam (110) onto the far bank. The A-frame (40) and, consequently, the home bank end of the launching. beam (110) are then raised, with the far bank end of the launching beam (110) remaining on the far bank. Once raised, a modular bridge (220) is suspended from the launching beam (110) and boomed out across the gap, additional modules being sequentially added. Once the bridge (220) has been completed, it is lowered into place, and the A-frame (40) is lowered once more. The launching beam (110) is raised from the far bank, and can then be retracted and dismantled. The launching beam is thus launched from a first, lower level where the load can be adequately reacted. Once deployed, however, there is no turning moment about the A-frame, which can thus be raised to a higher level to permit a bridge to be constructed beneath the launching beam (110).

26 Claims, 6 Drawing Sheets

BRIDGE CONSTRUCTION

This invention was made with Government support under Contract No. DAAE07-96-C-X189 awarded by The Tank, Automotive and Armaments Command (TACOM), Department of Defense. The Government has certain rights in this invention.

TECHNICAL FIELD

This invention relates to a method for constructing a modular bridge across a span, and to an apparatus for use in such a method.

BACKGROUND OF THE INVENTION

Structures, such as removable bridges, for crossing difficulties in terrain are well known. Such difficulties may include, for example, gaps formed by ditches, canals and rivers.

Although the construction of a bridge for light traffic is comparatively straightforward, providing a bridge capable of supporting heavy ground equipment is of considerably greater difficulty.

In one approach, a relatively lightweight launching rail or beam is first extended across the gap to be spanned. This rail acts as a load carrying member, to support a modular bridge. The bridge is suspended from the rail and then extended across the gap. In that case, the overhead rail has the advantage that, by using a wire rope and winch system, power can readily be provided to propel the bridge across the gap and subsequently to lower it onto the banks.

The structure described above is particularly suitable for undecked twin girder bridges, that is, bridges having generally parallel, spaced girders in a longitudinal direction but without transverse deck members. The rail is deployed from a central pylon between the two girders. Such an arrangement is advantageous because the pylon can be easily designed to react to the very large cantilevered loads associated with launching the rail.

Difficulties exist, however, in applying the above arrangement to pre-decked bridges, that is, bridges containing transverse deck members which are affixed to the longitudinal girders prior to extending the bridge across a gap. In particular, it is difficult to design a structure from which the rail can be launched and which does not obstruct the space beneath the rail.

One possible solution would be to provide a low level rail over which the bridge is launched. However, this has significant disadvantages in that the rail must be left in place after the bridge is built. This approach also leads to unattractive complexity in providing power for the movement of the bridge in both the horizontal and vertical planes.

SUMMARY OF THE INVENTION

According to the present invention, there is provided a method of constructing a modular bridge across a span, comprising the steps of:

(a) extending a launching rail across said span, said launching rail being supported by a launching rail support;

(b) locating a first end of said launching rail on the far bank of said span;

(c) raising the launching rail support; and, (d) extending said modular bridge across said span, said bridge being at least partially suspended from said launching rail.

The launching rail is thus launched from a lower portion of the launching rail support, where it is possible to provide adequate reaction to the launching loads. By then raising the launching rail support following deployment of the launching rail, space is then available for building the bridge beneath the launching rail.

Once the launching rail is across the gap and supported on the far bank, there is no turning moment on the launching rail support and the launching rail support can thus be elevated enabling the bridge to be introduced beneath the launching rail.

Preferably, the launching rail is modular, the method further comprising connecting at least one further launching rail module to a first launching rail module, and extending the first and the at least one further modules towards the far bank of the span.

Modular launching rails and bridges are particularly convenient. The launching rail support may be attached to a mobile bridge emplacement vehicle, and the launching rail and bridge modules can then be located on a separate trailer, for example, and lifted by a crane or the like into position on the vehicle.

Preferably, the first end of the launching rail is located on the far bank of the span by raising the other end of the launching rail, the launching rail pivots about the launching rail support.

The present invention also extends to a launch assembly suitable for use in constructing a modular bridge across a span, said launch assembly comprising:

(a) a launching rail support, for supporting a launching rail as it is extended towards a far bank of said span, (b) pivoting means for pivoting said launching rail about said launching rail support such that a first end of said launching rail is supported by said far bank, said launching rail support being raised once said first end of said launching rail is supported by said far bank such that a bridge may be suspended from said launching rail.

BRIEF DESCRIPTION OF THE DRAWINGS

The invention can be put into practice in various ways, some of which will now be described by way of example with reference to the accompanying drawings, in which.

DETAILED DESCRIPTION OF THE PREFERRED EMBODIMENT

Figure 1:
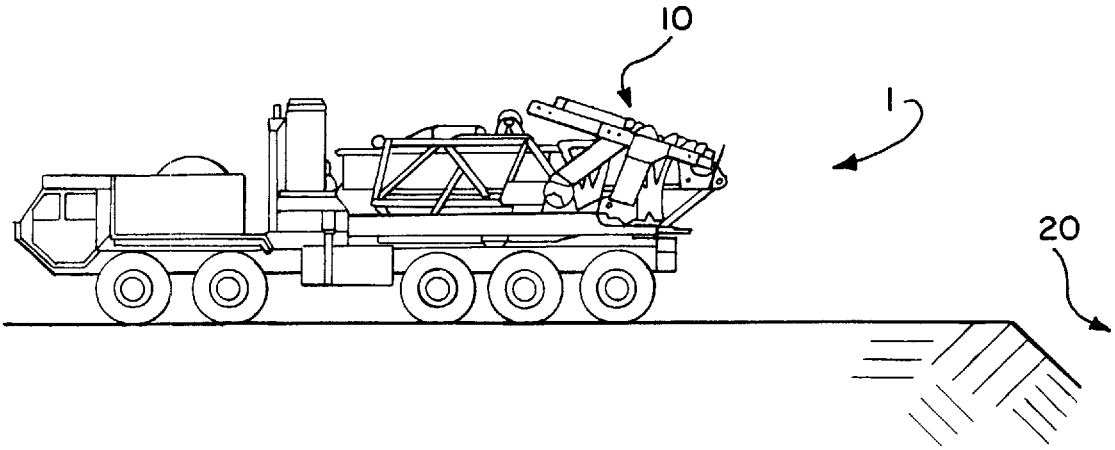
FIGS. 1–3 and 5–17 show the sequential stages involved in constructing the modular bridge according to one embodiment of the invention; and, FIGS. 4*a,* 4*b* and 4*c* show sectional views of the A-frame employed to launch the bridge and rail.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

The method of deploying the modular bridge of the preferred embodiment will now be described with reference to the drawings.

In FIG. 1, a launch vehicle 1 is shown. This vehicle comprises a launch assembly, designated generally by reference numeral 10, which will be described in more detail later on.

Upon arrival at the site of a gap 20 to be spanned by the bridge, the launch vehicle 1 is positioned as shown in FIG. 1, with the launch assembly 10 facing the gap 20.

Figure 2:
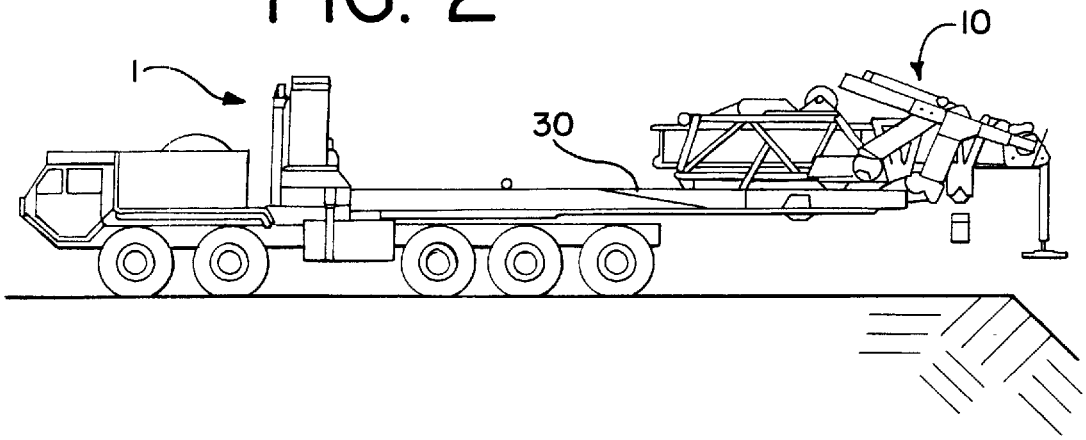

Referring now to FIG. 2, the launch assembly 10 is extended backwards towards the gap 20 on a sliding frame 30. This is normally carried out by an operator operating controls located, for example, on the side of the launch vehicle 1. The sliding frame 30 is hydraulically operated.

Figure 3:
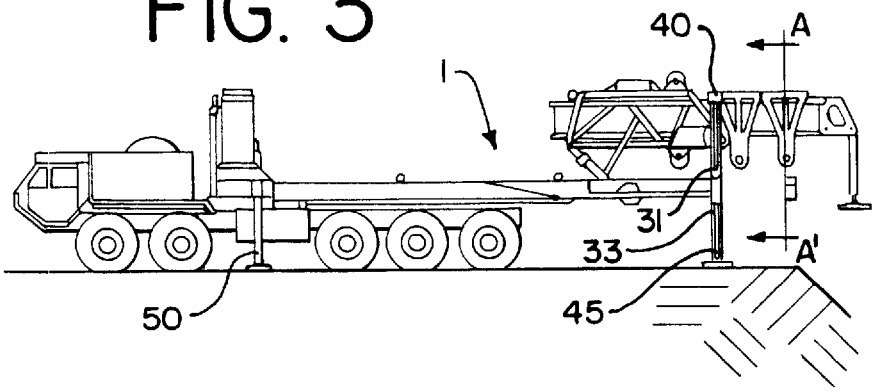
Figure 4A:
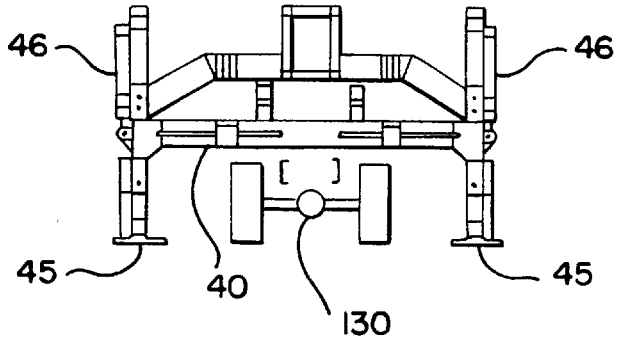

Next, an A-frame 40 is moved from its stored position in the launch assembly 10, shown in FIGS. 1 and 2, into its upright, deployed position shown in FIG. 3. In the upright position, two feet 45 rest upon the ground adjacent the gap 20. FIG. 4*a* shows the A-frame 40 in sectional view along the line AA' of FIG. 3.

Simultaneously, front stabilizers 50 are lowered to the ground. The A-frame has a spirit level located on it to enable the back of the launch vehicle 1 to be accurately levelled.

Figure 5:
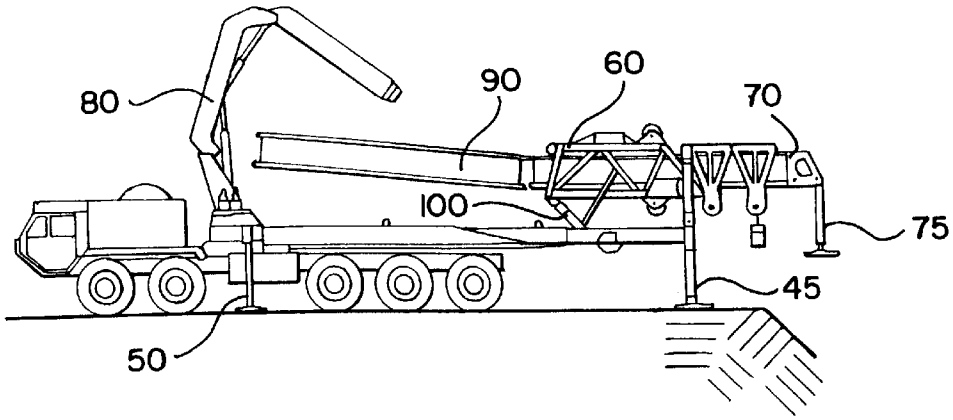

Next, a launching beam is constructed (FIG. 5). The launch assembly 10 includes a launch frame 60, into which is already loaded a first end beam member 70. A crane 80, located towards the front of the launch vehicle 1, is moved from its stowed position shown in FIGS. 1 to 3 and is used to lift a second beam member 90 from its storage location. Typically, this will be a trailer (not shown) towed by a separate vehicle and located next to the launch vehicle 1.

The second beam member 90 is moved by the crane, under the control of an operator, until it abuts the first end beam member 70. Beam pins (not shown) are inserted by a further operator standing on the sliding frame 30.

Figure 6:
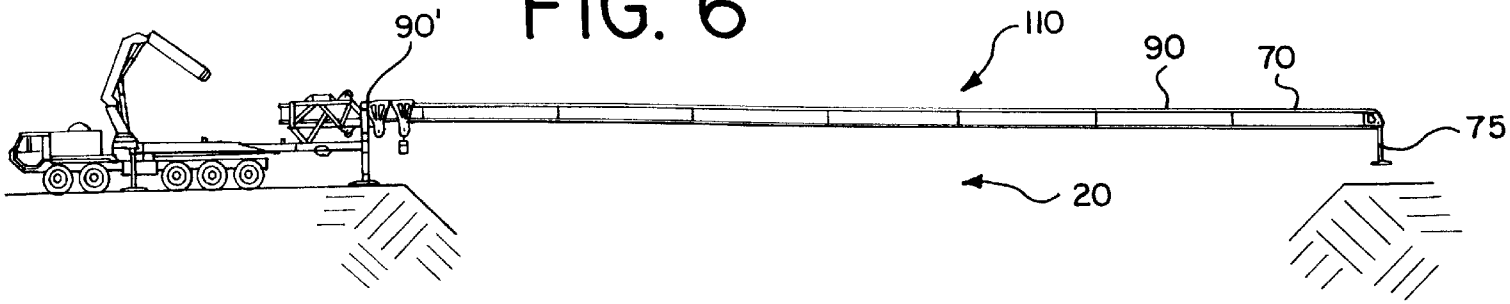

Further launching beam members are added sequentially, and after each beam member has been added the beam is extended out across the gap 20. When the last beam member 90' has been added and boomed forward (FIG. 6), a final pin is inserted which locks the last beam member 90' to the launch frame 60. Then, a jack 100 (shown more clearly in FIG. 5), which is removably attached between the launch frame 60 and sliding frame 30, is operated in order to pivot the completed launching beam about the A-frame 40. The last beam member 90' is raised by the jack 100, causing the first end beam member 70 to drop towards the far bank of the gap 20. A launching beam support 75, which is generally perpendicular to the first end beam member, will then contact the ground on the far bank of the gap 20, as shown in FIG. 7.

Figure 7:
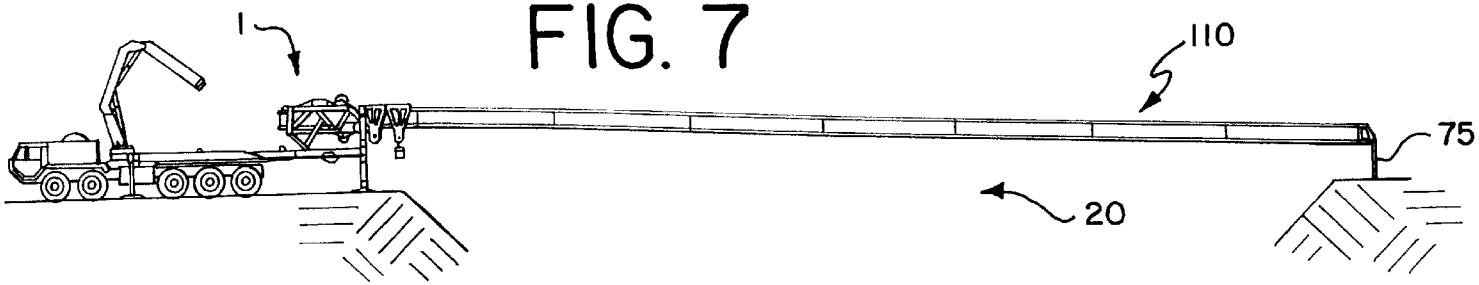

Because the moment of the launching beam is to the right of the A-frame, which acts as a pivot, the launching beam 110 will remain in the position shown in FIG. 7 without any further need for the jack 100. The jack 100 is therefore disconnected from the sliding frame 30 and stowed against the launch frame 60. This is seen in close-up in FIG. 8.

Figure 4B:
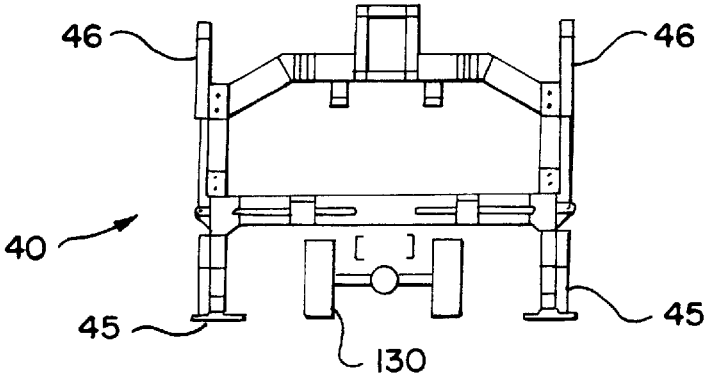
Figure 8:
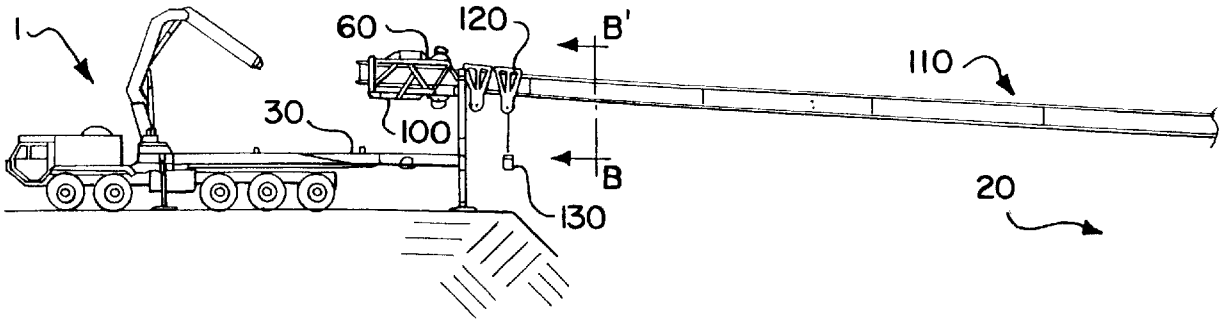

The final stage of the deployment of the launching beam is to raise the upper part of the A-frame. This is done by operating the hydraulic cylinders 46. FIG. 4*b*, which is a sectional view along the line BB' of FIG. 8, shows this. A forward carriage 120, which is suspended from the launching beam, has a sling 130, the purpose of which will be described below.

The load-bearing bridge itself may now be constructed. This is described with reference to FIGS. 4*c* and 9 to 17.

Figure 4C:
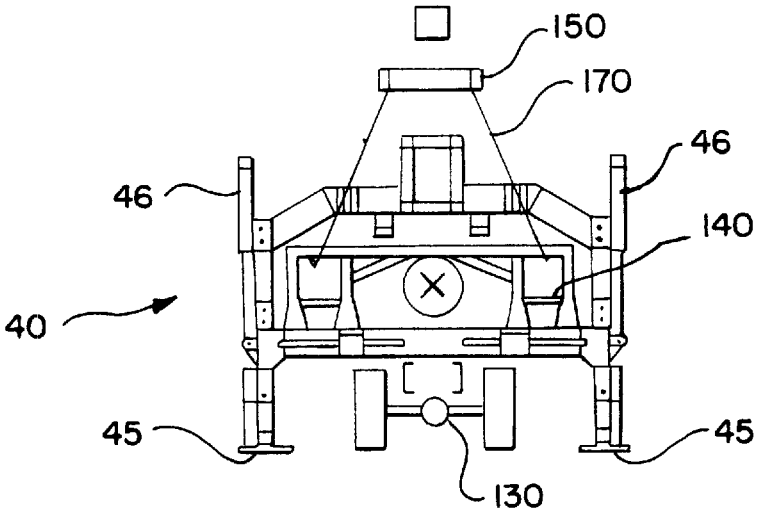
Figure 9:
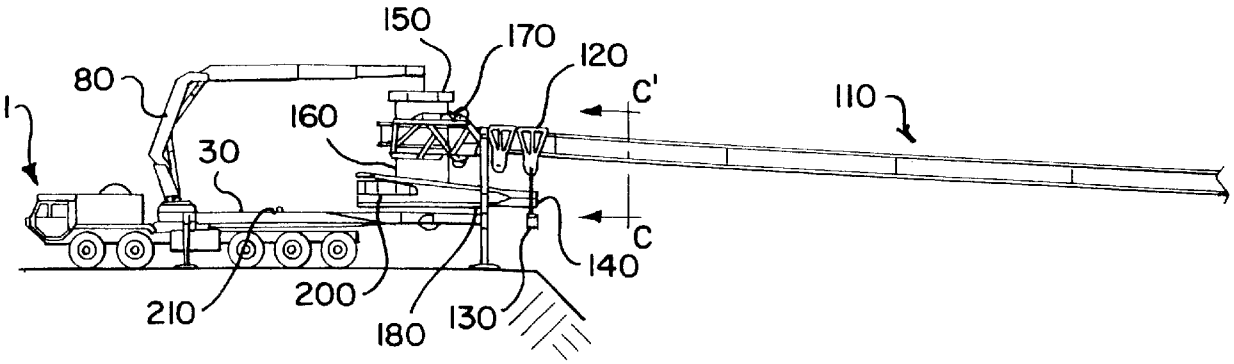

The first stage is for the crane 80 to pick up the bridge end ramp 140 from its stored location, which will normally be on a trailer (not shown) arranged adjacent to the launch vehicle 1. In order to raise the bridge end ramp 140, a sling assembly 150 is attached to the crane end, as seen in FIG. 9. The sling assembly has rear and forward slings 160,170 which attach to the bridge end ramp 140. The bridge end ramp 140 is located over the launch vehicle and then inserted forwardly (i.e., from left to right when looking at FIG. 9) into the A-frame, such that the bridge end ramp 140 rests upon rear rollers 180 in the A-frame 40 as shown in FIG. 4*c*. The forward sling 170 is removed, leaving only the rear sling 160 attached, so that the toe of the bridge end ramp 140 can be pushed through the A-frame. The end of the ramp is then attached via the sling 130 to the forward carriage. The position is then as shown in FIG. 9.

Figure 10:
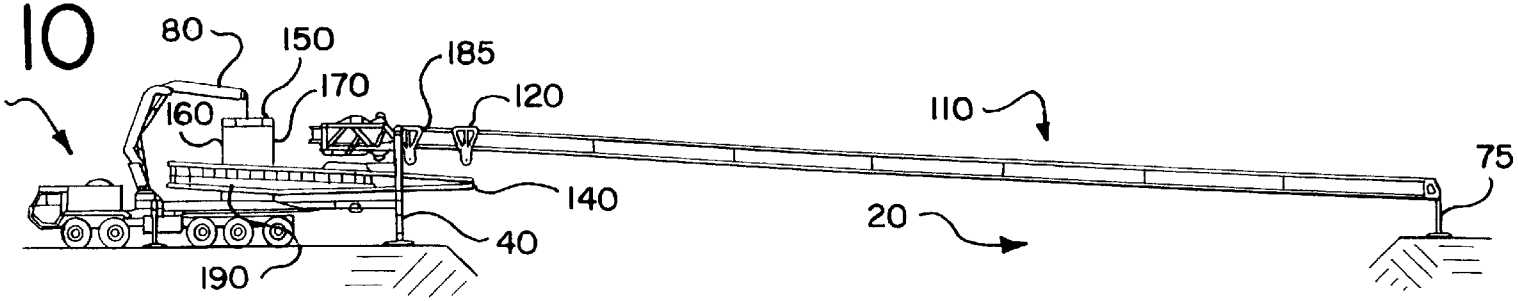
Figure 11:
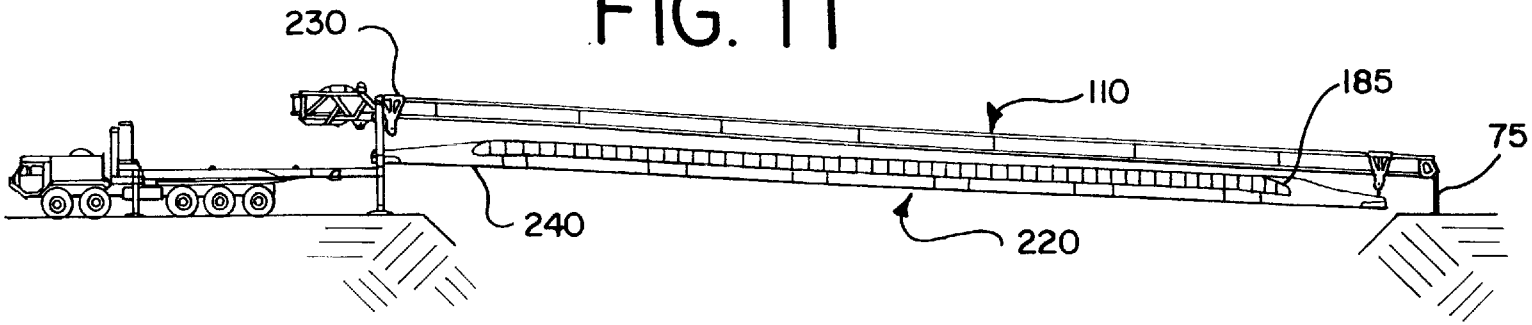
Figure 12:
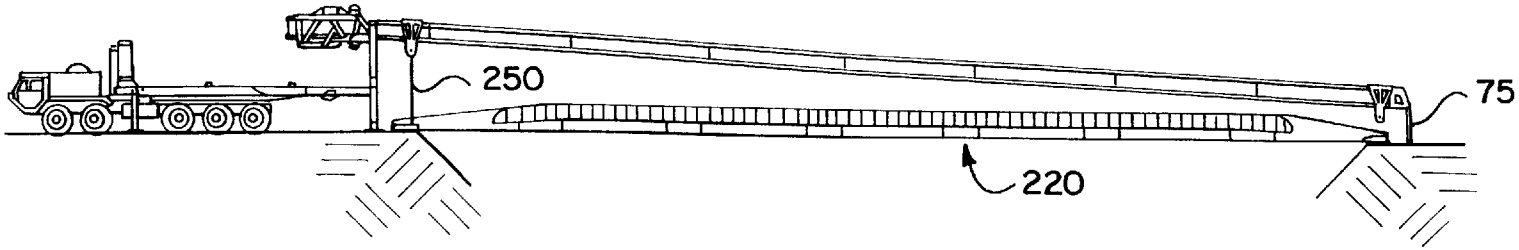

A first parallel bridge module 190 is lifted from the adjacent trailer (not shown), again using the sling assembly 150. The crane brings the first parallel bridge module 190 into position on the launch vehicle 1, and the bridge end ramp 140 and first parallel bridge module 190 are connected (FIG. 10). This is normally carried out by first engaging shoot bolts on the top of the two bridge modules as they are brought together, and then, as the first parallel bridge module is lowered, bottom pins are inserted. At this stage, the bridge end ramp 140 is supported on the rollers 180 in the A-frame, and also on rollers 200 on the sliding frame 30 (see FIG. 9). A further set of rollers 210 on the sliding frame 30 support the now-attached first parallel bridge module 190.

The forward carriage 120 is now winched backwards (i.e., in a rightwardly direction as seen in the Figures) by means of winches 31,33 (FIG. 3). The two assembled modules are supported on the rollers 180 in the A-frame, and by the forward carriage 120 via the sling 130. The rollers 200,210 on the sliding frame 30 may then be lowered out of the way.

Further parallel bridge modules are connected to the first parallel bridge module 190 in exactly the manner described above. After the addition of each parallel bridge module, the forward carriage 120 is boomed forward. When the final bridge module has been attached (FIG. 11), which is a second bridge end ramp 240, a sling 250, which is extendable from the rear carriage 230, is attached to Next, the sling 250 is raised by a winch, thus raising the second bridge end ramp 240, and thus the "home" end of the bridge 220 off the rollers 180 in the A-frame 40. Finally, the bridge can be winched forward until it is in the correct location over the gap 20, and is then lowered (FIG. 12) by operating winch assemblies in the forward and rear carriages. Once on the ground, the forward and rear slings are removed. The A-frame is then lowered by employing hydraulic cylinders 46 (FIG. 4*b*).

Figure 13:
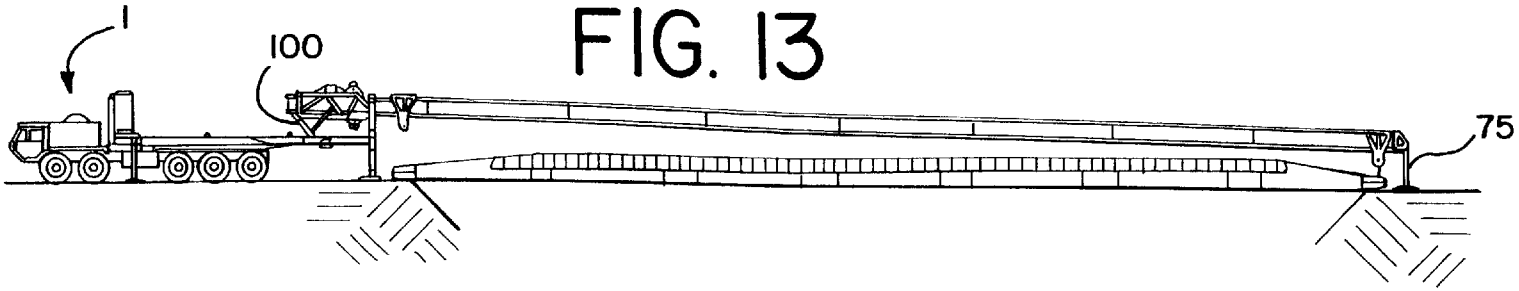
Figure 14:
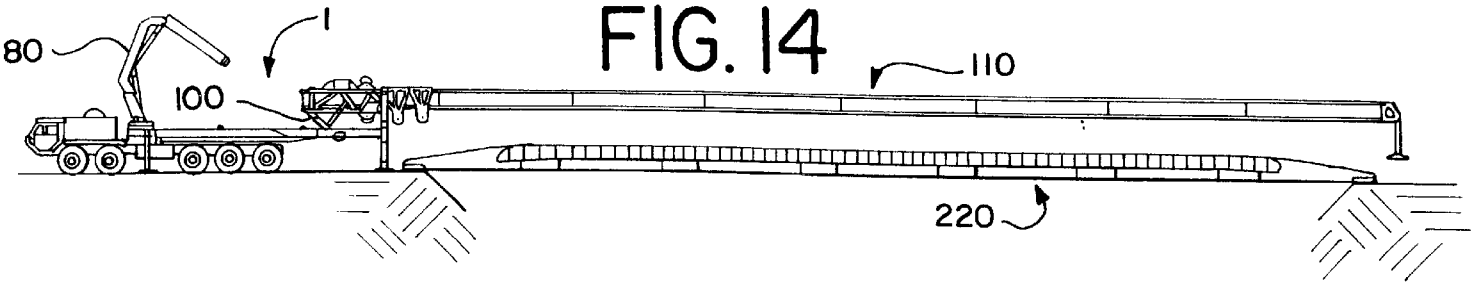

Once the upper part of the A-frame has been lowered, the jack 100 is re-attached to the sliding frame 30 (FIG. 13). The forward and rear carriages 120,230 are then winched back to their starting position. The jack 100 which has been re-attached to the sliding frame 30, allows the launching beam to be pivoted about the A-frame 40, so lifting the beam support 75 off the far bank (FIG. 14).

Figure 15:
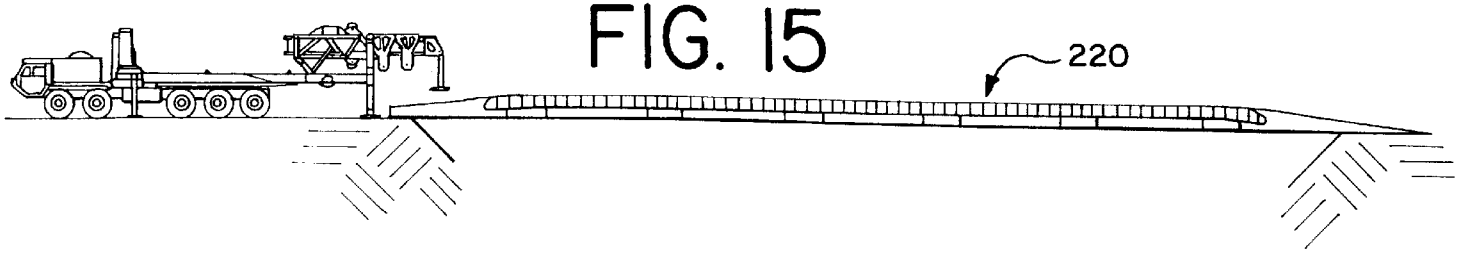
Figure 16:
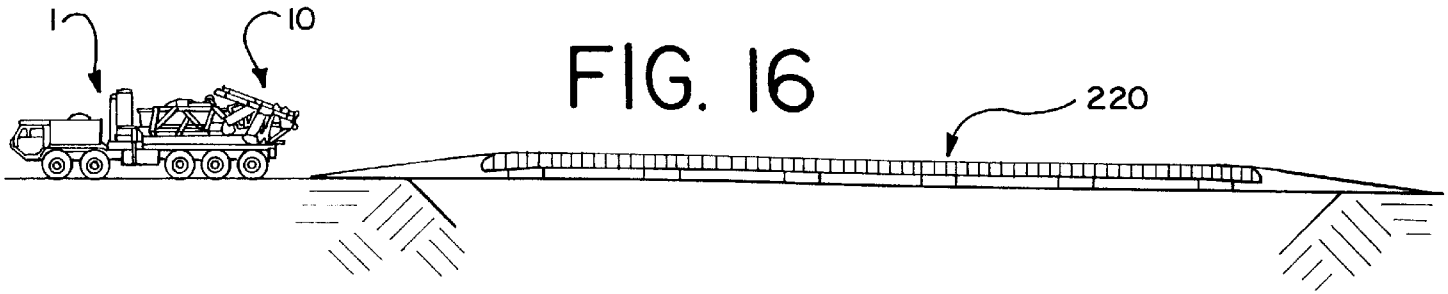
Figure 17:
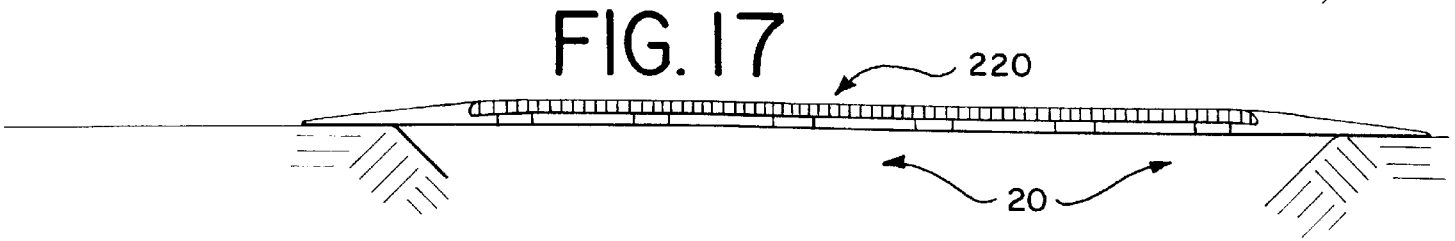

The launching beam is then retracted towards the launch vehicle 1, and dissembly of the launching beam 110 is the reverse of its assembly. When all of the individual members of the launching beam 110 have been disconnected and removed, by use of the crane 80, as shown in FIG. 15, the launch assembly 10 can be stowed away again (FIG. 16). Once the launch vehicle 1 has been moved, the bridge is ready to accept traffic, as shown in FIG. 17.

Bridge retrieval is the reverse of launch. As the bridge is symmetrical about its center, it may be recovered from either end.

There are, of course, a number of variations on the method of deploying the bridge. For example, the jack 100 could be replaced by a solid link and the ability to alternate the inclination of the launching beam (to accommodate different bank heights) could simply be achieved by varying the height of the upper cross member of the A-frame 40. Alternatively, this cross member could be reduced in section, i.e., in strength, by having a removable link between it and the lower member, thus providing a more direct load path. Instead of providing a pivoting mechanism at the rear bank, a telescopic or other movable support could be provided on the far bank to take the initial load. Such a support could then be dropped later to lower the bridge to the ground.

It is understood that the invention is not limited to the specific features shown, since the means of construction and method herein disclosed comprise only a preferred form of putting the invention into effect. Other modifications and other variations of the apparatus and method will occur to those of ordinary skill in the art.

Accordingly, the foregoing description is to be interpreted in an illustrative, and not in a limitative sense, and the invention is claimed in any of its forms or modifications with the legitimate, valid scope of the appended claims appropriately interpreted in accordance with the doctrine of equivalents.

What we claim is:

1. A method of constructing a modular bridge across a span having a far bank, comprising the steps of:

(a) extending a launching rail supported by a launching rail support across the span;

(b) locating and contacting a first end of the launching rail on the ground on the far bank of the span;

(c) raising the launching rail support; and, (d) extending the modular bridge across the span with the modular bridge being at least partially suspended from the launching rail.

2. The method of claim 1 wherein the launching rail is modular and step (a) further comprising the steps of:

connecting at least one further launching rail module to a first launching rail module; and, extending the first and the further module toward the far bank of the span.

3. The method of claim 2 wherein the first end of the launching rail is located on the far bank of the span by raising the other end of the launching rail causing the launching rail to pivot about the launching rail support.

4. The method of claim 3 wherein the launching rail support is an A-shaped frame.

5. The method of claim 4 wherein step (d) further comprising the steps of:

suspending a first bridge module from the launching rail;

connecting at least one further bridge module to the first bridge module; and, extending the first and the further bridge modules toward the far bank of the span.

6. The method of claim 5 wherein the first and the further bridge modules are further supported by a bridge support member as they are extended towards the far bank of the span.

7. The method of claim 6 wherein the launching rail support is attached to a mobile bridge emplacement vehicle.

8. The method of claim 1 wherein the first end of the launching rail is located on the far bank of the span by raising the other end of the launching rail causing the launching rail to pivot about the launching rail support.

9. The method of claim 1 wherein the launching rail support is attached to a mobile bridge emplacement vehicle.

10. The method of claim 1 wherein the launching rail support is an A-shaped frame.

11. The method of claim 1 wherein step (d) further comprising the steps of:

suspending a first bridge module from the launching rail;

connecting at least one further bridge module to the first bridge module; and, extending the first and the further bridge modules toward the far bank of the span.

12. The method of claim 1 wherein the first and the further bridge modules are further supported by a bridge support member as they are extended toward the far bank of the span.

13. A launch assembly for use in constructing a modular bridge across a span having a far bank comprising:

(a) a launching rail;

(b) a launching rail support being extendible from an initial rail launching position to a second bridge extending position, the launching rail support in the initial rail launching position serving to support the launching rail as the launching rail is extended towards the far bank of the span;

(c) a pivoting means for pivoting the launching rail about the launching rail support such that a first end of the launching rail is supported on the ground on the far bank; and, (d) a means for suspending the modular bridge from the launch rail as the modular bridge is extended across the span with the launching rail support in the second bridge extending position.

14. The launch assembly of claim 13 wherein the launching rail is supported by the launching rail support across the entire span with the modular bridge across the span being at least partially suspended from the launching rail.

15. The launch assembly of claim 14 wherein the launching rail is modular, at least one further launching rail module is connected to a first launching rail module, and the first and the further modules extend toward the far bank of the span.

16. The launch assembly of claim 15 wherein the first end of the launching rail is located on the far bank of the span by raising the other end of the launching rail causing the launching rail to pivot about the launching rail support.

17. The launch assembly of claim 16 wherein the launching rail support is an A-shaped frame.

18. The launch assembly of claim 17 wherein the first bridge module is supported from the launching rail, the further bridge module is connected to the first bridge module, and the first and the further bridge modules extend toward the far bank of the span.

19. The launch assembly of claim 18 wherein the first and the further bridge modules are further supported by a bridge support member as they extend toward the far bank of the span.

20. The launch assembly of claim 13 wherein a mobile bridge emplacement vehicle supports the launch assembly.

21. The launch assembly of claim 13, wherein the launching rail support comprises a frame having two side arms disposed either side of a central bridge-receiving aperture, each side arm including jack means for extending the side arms to the second position.

22. The launch assembly of claim 21, wherein the frame is an A-frame.

23. A method of constructing a modular bridge across a span having a far bank, comprising the steps of:

(a) extending a launching rail supported by a launching rail support across the span;

(b) locating and contacting a first end of the launching rail on the ground on the far bank of the span;

(c) raising the launching rail support;

(d) providing a modular bridge as a plurality of modules, each module constituting a length of the bridge disposed for arrangement in a single sequence to form the bridge; and, (e) extending the modular bridge across the span with the modular bridge being suspended from the launching rail.

24. A method of constructing a modular bridge across a span having a far bank, comprising the steps of:

(a) providing a launching rail support formed as a frame which can be raised from an initial rail launching position to a second bridge extending position;

(b) extending a launching rail supported by the launching rail support in its initial rail launching position across the span;

(c) locating and contacting a first end of the launching rail on the ground on the far bank of the span;

(d) raising the launching rail support to the second bridge extending position;

(e) providing a modular bridge as a series of lengths, each length being constituted by a single module, and inserting the modules sequentially one by one through the launching rail frame beneath the launching rail; and, (f) extending the modular bridge across the span with the modular bridge being at least partially suspended from the launching rail.

25. The method of claim 24, wherein the frame forming the launching rail support has two side arms disposed either side of a central bridge-receiving aperture, each side arm including jack means for extending the side arms to the second bridge extending position.

26. The method of claim 25, wherein the frame is an A-frame.

* * * * *

UNITED STATES PATENT AND TRADEMARK OFFICE

CERTIFICATE OF CORRECTION

PATENT NO. : 5,915,423
DATED : June 29, 1999
INVENTOR(S) : Lindsey Maitland Thomas It is certified that errors appear in the above-identified patent and that said Letters Patent is hereby corrected as shown below:

Col. 4, line 32, after "is attached to" please insert --it.--

Col. 6, line 6, please delete "claim 1" and insert therefor --claim 11--

Signed and Sealed this

Tenth Day of April, 2001

*Attest:*

Nicholas P. Godici

NICHOLAS P. GODICI

*Attesting Officer*

*Acting Director of the United States Patent and Trademark Office*